US007773038B2

(12) United States Patent
Degner et al.

(10) Patent No.: US 7,773,038 B2
(45) Date of Patent: Aug. 10, 2010

(54) ELECTRONIC DEVICES WITH ANTENNA SENSORS

(75) Inventors: Brett William Degner, Menlo Park, CA (US); Chris Ligtenberg, San Carlos, CA (US); Douglas Blake Kough, San Jose, CA (US); Paul Andrew Gojenola, San Jose, CA (US)

(73) Assignee: Apple Inc., Cupertino, CA (US)

( * ) Notice: Subject to any disclaimer, the term of this patent is extended or adjusted under 35 U.S.C. 154(b) by 192 days.

(21) Appl. No.: 12/061,210

(22) Filed: Apr. 2, 2008

(65) Prior Publication Data

US 2009/0251374 A1 Oct. 8, 2009

(51) Int. Cl.
*H01Q 1/24* (2006.01)

(52) U.S. Cl. ..... 343/702; 343/894

(58) Field of Classification Search ..... 343/702, 343/760, 894; 455/90.3
See application file for complete search history.

(56) References Cited

U.S. PATENT DOCUMENTS 5,913,174 A 6/1999 Casarez et al.
5,983,119 A 11/1999 Martin et al.
6,259,409 B1 7/2001 Fulton et al.
6,262,684 B1 * 7/2001 Stewart et al. ..... 343/702
6,297,778 B1 * 10/2001 Phillips et al. ..... 343/702
7,312,758 B2 * 12/2007 Seybold ..... 343/702
2005/0093762 A1 5/2005 Pick

* cited by examiner

*Primary Examiner*—Tan Ho
(74) *Attorney, Agent, or Firm*—Treyz Law Group; G. Victor Treyz; David C. Kellogg

(57) ABSTRACT

Electronic devices may be provided with sensors for determining the presence and position of extendable and removable antennas. The antennas may extend by rotating about an axis, by reciprocating along their length, or by flexing from a retracted position to an extended position. The electronic device may determine when a removable antenna is attached or detached using signals from the sensors. The electronic device may determine the extent to which an antenna has been extended using signals from the sensors. The electronic device may control the operation of a radio-frequency transceiver that is coupled to the antenna based on signals from the sensors. The electronic device may turn the transceiver off when the antenna is retracted or removed. When the antenna is partially extended, the electronic device may place the transceiver in a low-power mode or place a dual-band transceiver into a single-band mode.

21 Claims, 13 Drawing Sheets

ELECTRONIC DEVICES WITH ANTENNA SENSORS

BACKGROUND

This invention relates to electronic devices with antennas, and more particularly, to electronic devices with sensors for determining antenna position.

It may be desirable to include wireless communications capabilities in an electronic device. Electronic devices may use wireless communications to communicate with wireless base stations. For example, electronic devices may communicate using the Wi-Fi® (IEEE 802.11) bands at 2.4 GHz and 5.0 GHz and the Bluetooth® band at 2.4 GHz. Electronic devices may also use other types of communications links. For example, electronic devices may communicate using cellular telephone bands at 850 MHz, 900 MHz, 1800 MHz, and 1900 MHz (e.g., the main Global System for Mobile Communications or GSM cellular telephone bands). Communications are also possible in data service bands such as the 3G data communications band at 2100 MHz (commonly referred to as UMTS or Universal Mobile Telecommunications System).

Many popular housing materials such as metal have a high conductivity. This poses challenges when designing an antenna for an electronic device with this type of housing. An internal antenna would be shielded by a high-conductivity housing, so internal antenna designs are often not considered practical in electronic devices with conductive cases. On the other hand, external antenna designs that protrude permanently from a device's housing may have an unattractive appearance. Permanently extended external antenna designs may also be susceptible to damage.

Retractable (extendable) antennas may be used to improve the visual appearance of an electronic device and may to reduce the likelihood of antenna damage. However, it may not be suitable to operate this type of antenna when the antenna is in its retracted position. Operation of a retractable antenna in its stowed position may cause circuit damage or may lead to unwanted power losses.

It would therefore be desirable to be able to determine the position of an antenna in an electronic device.

SUMMARY

In accordance with an embodiment of the present invention, sensors in electronic devices are provided for determining the presence and position of extendable and removable antennas. A removable antenna may be physically or magnetically coupled to an electronic device and may be removed from the electronic device without damaging the antenna or the electronic device.

The antenna may be extendable. The electronic device may have a conductive housing. The antenna may have improved transmission and reception efficiencies when the antenna is placed in an extended position away from the conductive housing. An extendable antenna may be configured to extend by rotating about an axis, by reciprocating along its length, or by flexing into an extended position.

The electronic device may have one or more sensors for determining the presence and/or position of an antenna. The sensors may be based on any suitable type of sensor such as pressure sensors, Hall effect sensors, proximity sensors, optical sensors, inductive sensors, mechanical switches, mechanically based rotational sensors, etc. For example, the electronic device may have one or more Hall effect sensors that detect the presence or proximity of a magnetic portion of the antenna.

In an electronic device that has a non-extendable but removable antenna, the electronic device may have one or more sensors capable of determining when the antenna is attached and when the antenna is not attached.

In an electronic device that has an antenna that extends by rotating about an axis, the electronic device may have one or more sensors to determine the amount of rotation of the antenna about that axis and whether the antenna is coupled to the electronic device. With one suitable arrangement, the electronic device may have a first sensor that detects when the antenna is coupled to the electronic device and one or more additional sensors that detect when the antenna is retracted or extended.

In an electronic device that has an antenna that extends by reciprocating along its length, the electronic device may have multiple sensors that are used to determine whether the antenna is attached and the amount of extension of the antenna. For example, if a single one of the multiple sensors detects the presence of the antenna, the electronic device may be able to conclude that the antenna is attached. Depending on which of the multiple sensors are able to detect the antenna, the electronic device may be able to deduce how extended the antenna is (e.g., partially or fully extended).

When the electronic device is configured with an antenna that flexes between retracted and extended positions, the electronic device may have one or more sensors to determine when the antenna is retracted and when the antenna is extended.

The electronic device may control the operation of a radio-frequency transceiver coupled to the antenna based on the signals received from one or more sensors. For example, the electronic device may configure the transceiver to operate in a low-power mode when the antenna is in a particular extended position or is in a retracted position. The low-power mode of the transceiver may reduce the power consumption of the transceiver. With one suitable arrangement, the electronic device may turn off the transceiver when the antenna is retracted or removed from the electronic device. With another suitable arrangement, the electronic device may alter the operation of a dual-band transceiver based on the sensor's signals. For example, the electronic device may configure the dual-band transceiver to operate in a single radio-frequency band when the antenna is partially extended and a second radio-frequency band (or both radio-frequency bands) when the antenna is fully extended.

Further features of the invention, its nature and various advantages will be more apparent from the accompanying drawings and the following detailed description.

DETAILED DESCRIPTION

Embodiments of the present invention relate generally to electronic devices and sensors for antennas in electronic devices. Sensors may be used in wireless electronic devices for determining the presence and position of extendable and removable antennas.

The wireless electronic devices may be any suitable electronic devices. As an example, the wireless electronic devices may be desktop computers or other computer equipment. The wireless electronic devices may also be portable electronic devices such as laptop computers or small portable computers of the type that are sometimes referred to as ultraportables. With one suitable arrangement, the portable electronic devices may be handheld electronic devices. These are merely illustrative examples.

Figure 1:
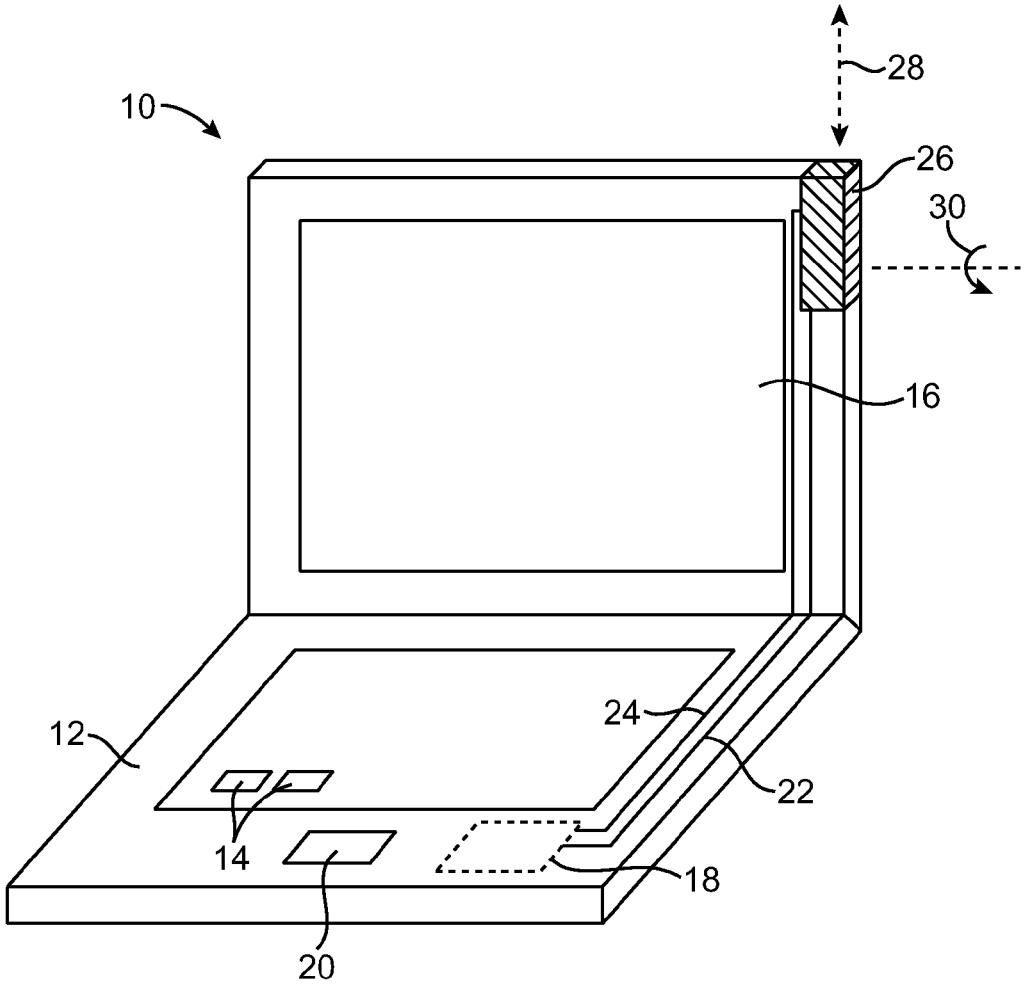
FIG. 1 is a perspective view of an illustrative electronic device and an illustrative extendable and removable antenna in a stowed state in accordance with an embodiment of the present invention.

An illustrative electronic device such as a portable electronic device in accordance with an embodiment of the present invention is shown in FIG. 1. Device 10 may be any suitable electronic device. As an example, device 10 may be a laptop computer.

Device 10 may handle communications over one or more communications bands. For example, wireless communications circuitry in device 10 may be used to handle cellular telephone communications in one or more frequency bands and data communications in one or more communications bands. Typical data communications bands that may be handled by the wireless communications circuitry in device 10 include the 2.4 GHz band that is sometimes used for Wi-Fi® (IEEE 802.11) and Bluetooth® communications, the 5.0 GHz band that is sometimes used for Wi-Fi communications, the 1575 MHz Global Positioning System band, and 3G data bands (e.g., the UMTS band at 1920-2170). These bands may be covered by using single band and multiband antennas. For example, cellular telephone communications can be handled using a multiband cellular telephone antenna and local area network data communications can be handled using a multiband wireless local area network antenna. As another example, device 10 may have a single multiband antenna for handling communications in two or more data bands (e.g., at 2.4 GHz and at 5.0 GHz).

Device 10 may have housing 12. Housing 12, which is sometimes referred to as a case, may be formed of any suitable materials including plastic, glass, ceramics, metal, other suitable materials, or a combinations of these materials.

Housing 12 or portions of housing 12 may also be formed from conductive materials such as metal. An illustrative metal housing material that may be used is anodized aluminum. Aluminum is relatively light in weight and, when anodized, has an attractive insulating and scratch-resistance surface. If desired, other metals can be used for the housing of device 10, such as stainless steel, magnesium, titanium, alloys of these metals and other metals, etc. In scenarios in which housing 12 is formed from metal elements, one or more of the metal elements may be used as part of the antenna in device 10. For example, metal portions of housing 12 and metal components in housing 12 may be shorted together to form a ground plane in device 10 or to expand a ground plane structure that is formed from a planar circuit structure such as a printed circuit board structure (e.g., a printer circuit board structure used in forming antenna structures for device 10).

Device 10 may have one or more buttons such as buttons 14. Buttons 14 may be formed on any suitable surface of device 10. In the example of FIG. 1, buttons 14 have been formed on the top surface of device 10. As an example, buttons 14 may form a keyboard on a laptop computer.

If desired, device 10 may have a display such as display 16. Display 16 may be a liquid crystal diode (LCD) display, an organic light emitting diode (OLED) display, a plasma display, or any other suitable display. The outermost surface of display 16 may be formed from one or more plastic or glass layers. If desired, touch screen functionality may be integrated into display 16. Device 10 may also have a separate touch pad device such as touch pad 20. An advantage of integrating a touch screen into display 16 to make display 16 touch-sensitive is that this type of arrangement can save space and reduce visual clutter. Buttons 14 may, if desired, be arranged adjacent to display 16. With this type of arrangement, the buttons may be aligned with on-screen options that are presented on display 16. A user may press a desired button to select a corresponding one of the displayed options.

Device 10 may have circuitry 18. Circuitry 18 may include storage, processing circuitry (e.g., control circuitry), and input-output components. Wireless transceiver circuitry in circuitry 18 may be used to transmit and receive radio-frequency (RF) signals. Communications paths such as coaxial communications paths and microstrip communications paths may be used to convey radio-frequency signals between transceiver circuitry and antenna structures in device 10. As shown in FIG. 1, for example, communications path 22 may be used to convey signals between antenna structure 26 and circuitry 18. Communications path 22 may be, for example, a coaxial cable that is connected between an RF transceiver (sometimes called a radio) and an antenna that operates in one or more radio-frequency bands. Antenna structures such as antenna structure 26 may be located adjacent to a corner of device 10 as shown in FIG. 1 or in other suitable locations. For example, antenna structure 26 may be located along a top edge of display 16, along any edge of device 10, or may be located in a suitable portion of any planar surface of device 10.

Antenna structure 26 may be removable and extendable. Antenna structure 26 may be physically but removably coupled to device 10 to allow the antenna structure to be removed without damaging antenna structure 26 or device 10. In another embodiment, antenna structure 26 may be magnetically coupled to device 10. The physical or magnetic coupling of antenna structure 26 to device 10 may facilitate easy replacement of antenna structure 26 and may facilitate a breakaway operation in which the antenna structure detaches from device 10 when a force is applied that could otherwise damage the antenna structure.

Antenna structure 26 may translate or rotate from a stowed position (e.g., the position shown in FIG. 1) into an extended position. The extended position of antenna structure 26 may be used to increase the efficiency of signal reception and transmission. For example, the extended position of antenna structure 26 may enhance wireless communications functionality by increasing the separation between the ground plane of device 10 and antenna resonating elements in antenna structure 26 relative to the separation between the ground plane and the antenna resonating elements in the stowed position.

Antenna structure 26 may be configured such that in the stowed position the antenna structure is flush, or nearly flush, with the surrounding portions of device 10. The stowed position of the antenna structure may improve the visual appearance of device 10. For example, when the antenna structure is in the stowed position, the antenna structure may blend in with the surrounding portions of device 10 and thereby reduce visual clutter. In the stowed position, the antenna structure is also generally less vulnerable to accidental detachment.

As illustrated in FIG. 1, antenna structure 26 may reciprocate along its longitudinal axis 28. Antenna structure 26 may reciprocate along longitudinal axis 28 when transitioning between its stowed state and its extended state.

In another embodiment, antenna structure 26 may rotate about an axis such as axis 30. Antenna structure 26 may rotate about axis 30 when transitioning between its stowed state and its extended state.

Device 10 may have sensors to determine whether antenna structure 26 is attached or detached and to determine whether antenna structure 26 is in an extended or stowed position. Information on the status of the antenna structure can also be gathered by determining whether radio frequency and/or DC signals are flowing properly between device 10 and antenna structure 26. Communications path 24 may be used to convey position signals between the sensors (or portions of antenna 26) and circuitry 18. Communications path 24 may be implemented using any suitable cable or wires.

Figure 2:
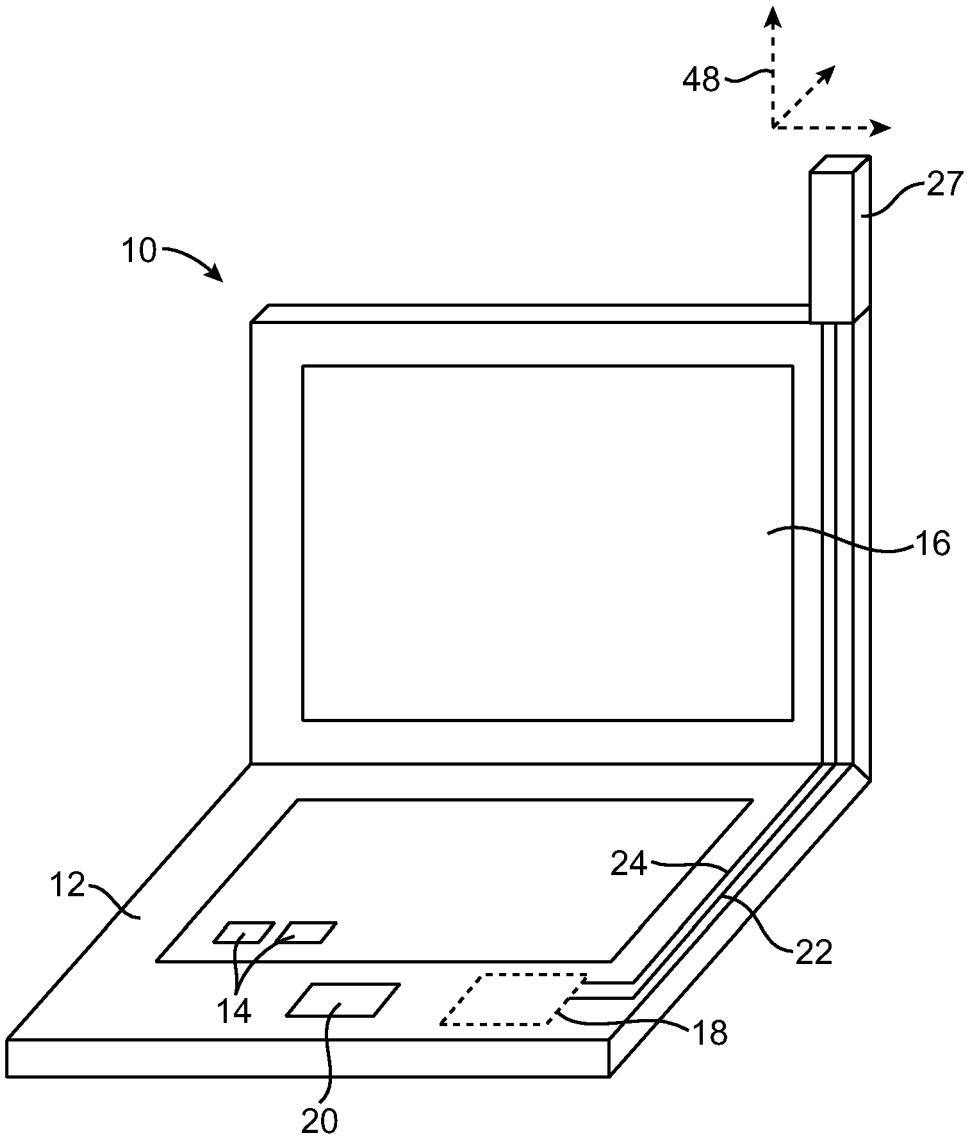
FIG. 2 is a perspective view of an illustrative electronic device and an illustrative removable antenna in a coupled state in accordance with an embodiment of the present invention.

As shown in FIG. 2, device 10 may have an unextendable removable antenna structure such as antenna structure 27 that does not reciprocate or rotate relative to housing 12. Unextendable removable antenna structure 27 may be magnetically coupled to device 10 to allow the antenna structure to be removed without damaging antenna structure 27 or device 10. In another embodiment, unextendable removable antenna structure 27 may be physically but removably coupled to device 10 (e.g., with a break-away coupling). Antenna structure 27 may be mounted on device 10 at any suitable attachment point. For example, antenna structure 27 may be attached to the top or side edge of device 10. As shown by dotted lines 48, antenna structure 27 may be removed in any desired direction excluding directions that would require the antenna structure to pass through device 10. A removable antenna structure such as antenna structure 27 may allow a user to utilize antenna structures of any suitable size or shape including those that may not have blended with surrounding portions of device 10 while still retaining the benefits of a magnetic or other break-away coupling that allows the antenna structure to break away undamaged.

Device 10 may have sensors to determine whether antenna structure 27 is attached or detached. Communications path 24 may be used to convey signals between these sensors and circuitry 18.

Figure 3:
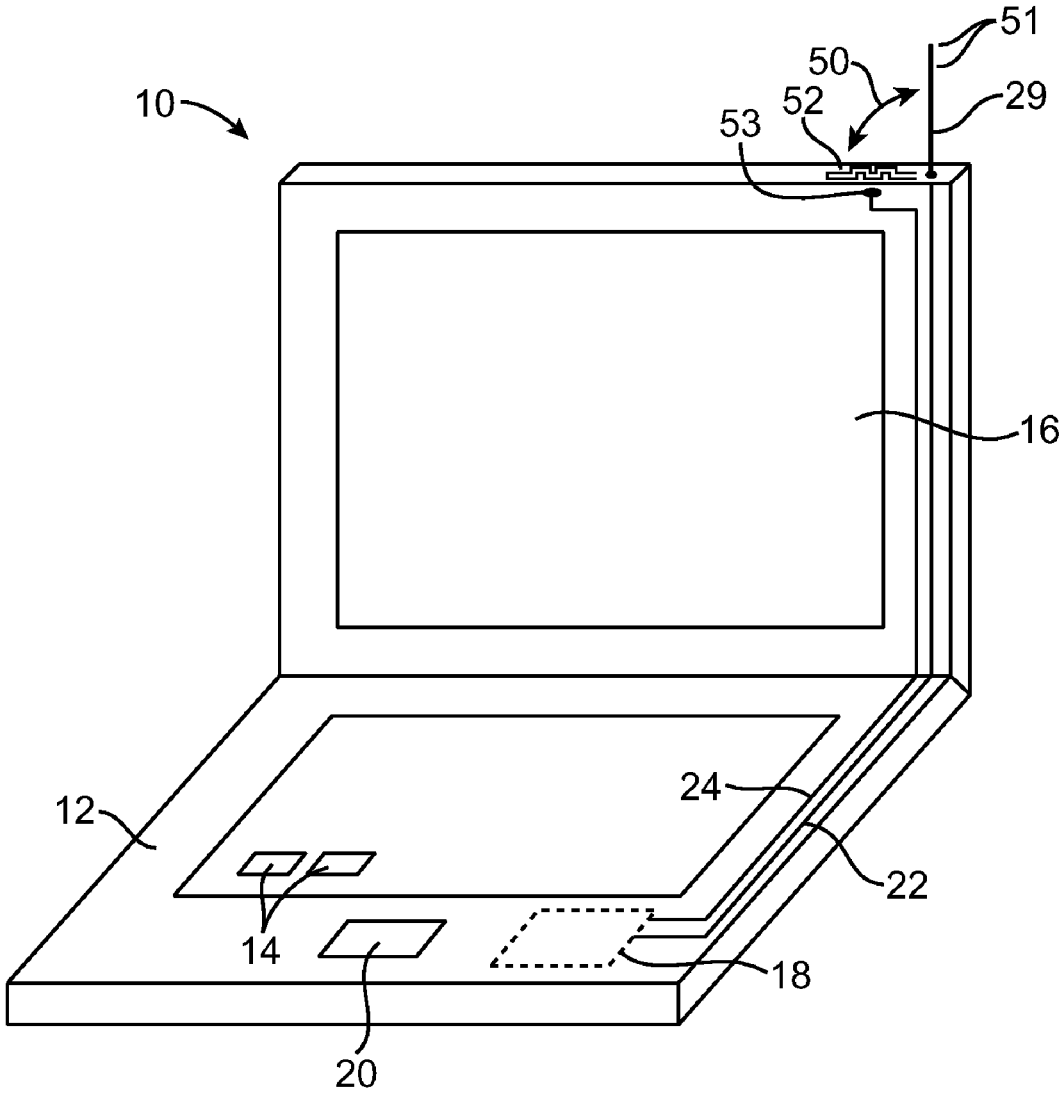
FIG. 3 is a perspective view of an illustrative electronic device and an illustrative resilient antenna in an extended state in accordance with an embodiment of the present invention.

As shown in FIG. 3, device 10 may have a resilient antenna structure that is flexible and extendable such as antenna structure 29. Antenna structure 29 may be formed from an elastic material that has an original shape such as the shape shown in FIG. 3. Antenna structure 29 may be in the shape of a wire. For example, antenna structure 29 may be an elastically flexible wire. Antenna structure 29 may be formed from a material that is capable of returning to its original shape (e.g., the shape shown in FIG. 3) even after extensive stress or deformation. For example, antenna structure 29 may be formed from a shape memory alloy, a superelastic material such as a nickel-titanium alloy (e.g., Nitinol®), or any other suitable material.

Antenna structure 29 may be mounted on device 10 at any suitable attachment point. For example, antenna structure 29 may be attached to the top or side edge of device 10. Antenna structure 29 may be stowed by bending the antenna structure 29 along line 50 into an antenna receptacle in device 10 such as antenna receptacle 52. Antenna structure 29 may be extended by removing the antenna structure from antenna receptacle 52 and allowing the antenna structure to elastically return to its natural position (e.g., the position of FIG. 3). Antenna structure 29 may have all of the properties of antenna structures 26 and/or 27 except for being removable as part of the normal operation of the antenna and device 10.

Antenna structure 29 may be magnetic or may have magnetic portions such as magnetic portion 51. Device 10 may have sensors to determine whether antenna structure 29 is in an extended or stowed position. For example, device 10 may have a sensor such as sensor 53 that may be used to determine when antenna structure 29 is stowed in antenna receptacle 52. With one suitable arrangement, sensor 53 may be a Hall effect sensor that senses the proximity of magnetic portion 51 (e.g., senses when antenna structure 29 is retracted or stowed in antenna receptacle 52). Communications path 24 may be used to convey signals between these sensors and circuitry 18.

Figure 4:
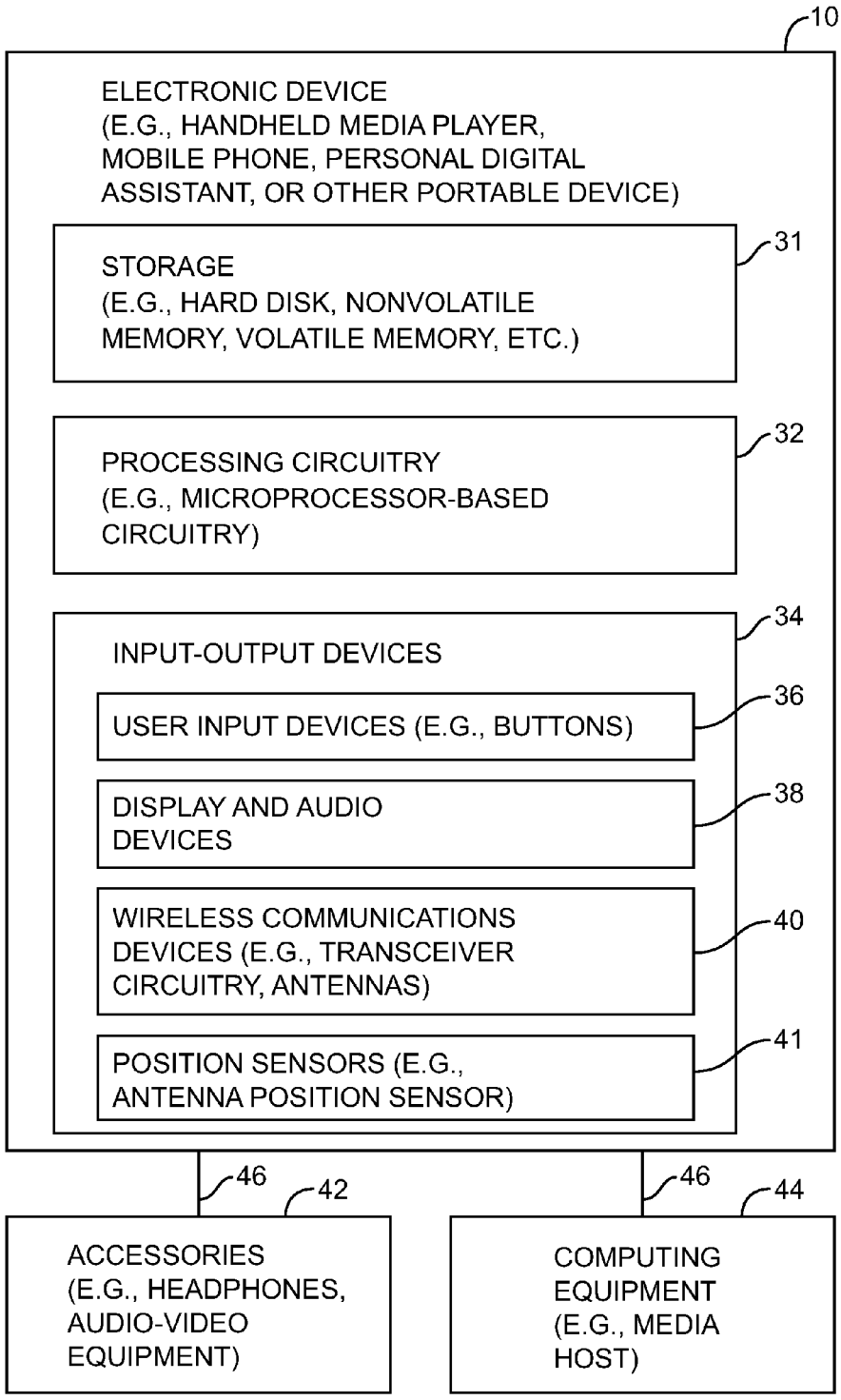
FIG. 4 is a schematic diagram of an illustrative electronic device in accordance with an embodiment of the present invention.

A schematic diagram of an embodiment of electronic device 10 is shown in FIG. 4. Electronic device 10 may be a notebook computer, a tablet computer, an ultraportable computer, a handheld computer, a global positioning system (GPS) device, a combination of such devices, or any other suitable portable electronic device (e.g., a mobile telephone).

As shown in FIG. 4, electronic device 10 may include storage 31. Storage 31 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 32 may be used to control the operation of device 10. Processing circuitry 32 may be based on a processor such as a microprocessor and other suitable integrated circuits. With one suitable arrangement, processing circuitry 32 and storage 31 are used to run software on device 10, such as internet browsing applications, voice-over-internet-protocol (VOIP) telephone call applications, email applications, media playback applications, operating system functions, etc. Processing circuitry 32 and storage 31 may be used in implementing suitable communications protocols. Communications protocols that may be implemented using processing circuitry 32 and storage 31 include internet protocols, wireless local area network protocols (e.g., IEEE 802.11 protocols—sometimes referred to as Wi-Fi®), protocols for other short-range wireless communications links such as the Bluetooth® protocol, protocols for handling 3G data services such as UMTS, cellular telephone communications protocols, etc.

Input-output devices 34 may be used to allow data to be supplied to device 10 and to allow data to be provided from device 10 to external devices. Display screen 16, keys 14, and touchpad 20 of FIG. 1 are examples of input-output devices 34.

Input-output devices 34 may include user input-output devices 36 such as buttons, touch screens, joysticks, click wheels, scrolling wheels, touch pads, key pads, keyboards, microphones, cameras, speakers, tone generators, vibrating elements, etc. A user can control the operation of device 10 by supplying commands though user input devices 36.

Display and audio devices 38 may include liquid-crystal display (LCD) screens or other screens, light-emitting diodes (LEDs), and other components that present visual information and status data. Display and audio devices 38 may also include audio equipment such as speakers and other devices for creating sound. Display and audio devices 38 may contain audio-video interface equipment such as jacks and other connectors for external headphones and monitors.

Wireless communications devices 40 may include communications circuitry such as radio-frequency (RF) transceiver circuitry formed from one or more integrated circuits, power amplifier circuitry, passive RF components, one or more antennas (e.g., antenna structures such as antenna structure 26 of FIG. 1), and other and other circuitry for handling RF wireless signals. Wireless signals can also be sent using light (e.g., using infrared communications).

Antenna position sensors 41 may include sensors such as one or more pressure sensors, Hall effect sensors (e.g., magnetic sensors), proximity sensors, optical sensors (e.g., photodetectors), inductive sensors, mechanical sensors (e.g., switches or rotational sensors), circuitry that senses the position of an antenna structure by detecting the presence of a current flow through a resistive element or wire path in the antenna structure, any other suitable sensors, or a combination of different types of sensors. With one suitable arrangement, an antenna may have one or more magnets built into its structure and an electronic device may have one or more Hall effect sensors that are capable of detecting the presence of the antenna's magnets. Sensors 41 may be used to determine whether or not an antenna is attached to device 10. Sensors 41 may also be used to determine the position of an extendable antenna that is attached to device 10 (e.g., whether the antenna is retracted, extended, or partially extended). For example, sensors 41 may be used to determine presence of an antenna and the amount of longitudinal or rotational extension of the antenna.

Device 10 can communicate with external devices such as accessories 42 and computing equipment 44, as shown by paths 46. Paths 46 may include wired and wireless paths. Accessories 42 may include headphones (e.g., a wireless cellular headset or audio headphones) and audio-video equipment (e.g., wireless speakers, a game controller, or other equipment that receives and plays audio and video content).

Computing equipment 44 may be any suitable computer. With one suitable arrangement, computing equipment 44 is a computer that has an associated wireless access point or an internal or external wireless card that establishes a wireless connection with device 10. The computer may be a server (e.g., an internet server), a local area network computer with or without internet access, a user's own personal computer, a peer device (e.g., another electronic device 10), or any other suitable computing equipment.

The antenna structures and wireless communications devices of device 10 may support communications over any suitable wireless communications bands. For example, wireless communications devices 40 may be used to cover communications frequency bands such as the cellular telephone bands at 850 MHz, 900 MHz, 1800 MHz, and 1900 MHz, data service bands such as the 3G data communications band at 2100 MHz (commonly referred to as UMTS or Universal Mobile Telecommunications System), Wi-Fi® (IEEE 802.11) bands (also sometimes referred to as wireless local area network or WLAN bands), the Bluetooth® band at 2.4 GHz, and the global positioning system (GPS) band at 1575 MHz. Device 10 can cover these communications bands and/or other suitable communications bands.

Figure 5:
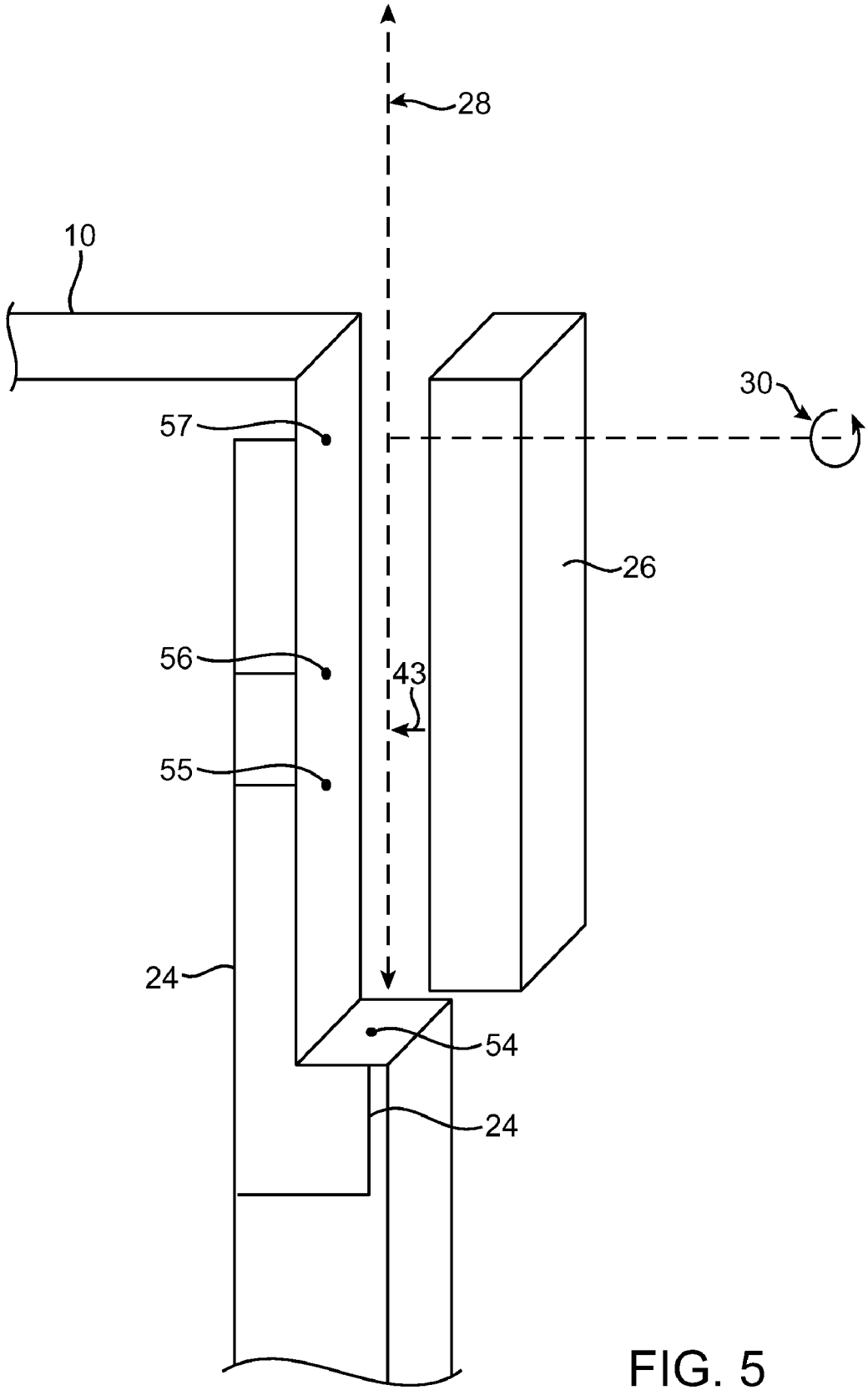
FIG. 5 is an exploded perspective view of a portion of an illustrative electronic device and an illustrative extendable and removable antenna in accordance with an embodiment of the present invention.

As shown in FIG. 5, device 10 may have an extendable and removable antenna structure such as antenna structure 26. Antenna structure 26 may be physically but removably coupled to device 10. With another suitable arrangement, antenna structure 26 may be magnetically coupled to device 10. Both methods of coupling of antenna structure 26 to device 10 may allow the antenna structure to be intentionally or accidently removed without damaging antenna structure 26 or device 10.

In the FIG. 5 example, antenna structure 26 is shown near device 10 in approximately its coupled and retracted state. The actual position of the antenna structures in its coupled and retracted state is approximately that represented by line 28. If the antenna structure were to be moved into alignment along line 28 by moving the antenna structure in the direction of arrow 43, the antenna structure would be in the approximate position of its coupled and retracted state.

Device 10 may have an antenna receptacle that houses sensors such as sensors 54, 55, 56, and 57 and that houses an antenna structure such as antenna structure 26 and structure 28 when the antenna structure is in its retracted or stowed position.

Antenna structure 26 may be extended from a retracted position that may maximize the aesthetics of device 10 to an extended position that may maximize the performance and efficiency of the antenna structure by reciprocating along its longitudinal axis (e.g., axis, 28). During reciprocation along axis 28, antenna structure 26 may be magnetically coupled to device 10. In another example, antenna structure 26 may rotate about an axis such as the axis of line 30 when transitioning between its retracted position and its extended position. Magnetic coupling or a physical break-away coupling may be used to hold antenna structure 26 in place on device 10 during rotational movement.

Antenna structure 26 may be electrically coupled to device 10. For example, an antenna resonating element (not shown) in antenna structure 26 may be electrically coupled through coupling structures in the antenna and device 10 and through communications path 22 to a radio-frequency transceiver that is part of circuitry 18.

Sensors such as sensors 54, 55, 56, and 57 may be used by device 10 to determine whether antenna structure 26 is attached and/or whether the antenna structure is in a retracted state or in an extended state. Sensors 54, 55, 56, and 57 may send signals to circuitry 18 indicating when antenna structure 26 is in position to transmit and receive radio signals (i.e., when the antenna structure is in an extended position). Circuitry 18 may use position signals from sensors 54, 55, 56, and 57 to enable or disable (e.g., power on or power down) wireless communications devices 40 that transmit and receive radio-frequency signals using an antenna resonating element in antenna structure 26. For example, circuitry 18 may turn off transceiver circuitry when the antenna structure is retracted or removed from device 10 in order to extend the battery life of device 10. If desired, circuitry 18 may generate alerts for a user of device 10 or take other appropriate actions based on antenna position information.

Any suitable combination sensors such as sensors 54, 55, 56, and 57 may be used to determine the amount of longitudinal extension of antenna structure 27 (e.g., the amount of extension along line 28). For example, in embodiments in which sensors 54, 55, 56, and 57 can only detect the presence of portions of antenna structure 26 that are within a short distance, sensor 54 may only detect the presence of the antenna when the antenna is in the fully retracted and coupled state. However, when the antenna is coupled and extended, or partially extended, device 10 may still be able to determine that the antenna is coupled using sensors 55, 56, and 57. For example, when the antenna is in a first extended position, sensors 54 and 55 may be uncovered and be unable to sense the presence of the antenna. In the first extended position, device 10 may be able to deduce that the antenna is in the first extended position from the signals of sensors 56 and 57 that indicate the antenna is present and the signals of sensors 54 and 55 that indicate the antenna is not present. When the antenna is in a second extended position, sensors 54, 55, and 56 may be unable to sense the presence of the antenna. In the second extended position, device 10 may be able to deduce that the antenna is in the second extended position from the signals of sensor 57 that indicates the antenna is present and the signals of sensors 54, 55, and 56 that indicate the antenna is not present.

In embodiments in which antenna structure 26 is configured to extend by rotating about axis 30, sensor 57 may be used as the sole sensor in determining the state of antenna structure 26. For example, sensor 57 may be able to detect not only the presence of antenna structure 26 but also the amount of rotation of the antenna structure around axis 30. Sensor 57 may be able to determine when antenna structure 26 has rotated to one or more extended positions. The extended positions may lie within a range of positions. For example, a first extended position may correspond to any angle around axis 30 that is between zero and ninety degrees and a second extended position may correspond to any angle around axis 40 that is between ninety degrees and a hundred and eighty degrees (e.g., with zero defined as the angle when the antenna is fully retracted). With another suitable arrangement, one or more of sensors 54, 55, or 56 may be used to determine when antenna structure 26 is rotated to the retracted position while sensor 57 is used to determine whether or not antenna structure 26 is coupled to device 10.

With another suitable arrangement, transceiver circuitry in device 10 (e.g., transceiver circuitry 40) may be used to determine whether antenna structure 26 is attached and/or whether the antenna structure is in a retracted state or in an extended state. For example, transceiver circuitry 40 may send signals (e.g., radio-frequency signals) to antenna structure 26 through path 22 and then monitor path 22 for the reflection of the signals. A strong reflection of the signal may indicate that, as an example, antenna structure 26 is either detached or is not in a proper extended state.

With one suitable arrangement, circuitry 18 may send signals to transceiver circuitry (e.g., wireless communications devices 40) to indicate that the circuitry should enter a low-power mode or a high-power mode. For example, circuitry 18 may direct the transceiver circuitry to enter a low-power mode when the antenna structure is in a partially extended position and to enter a full-power mode when the antenna structure is in a fully extended position. With another suitable arrangement, circuitry 18 may activate a first transceiver configured to operate in a first radio-frequency (RF) band when the antenna structure is in a partially extended position and may activate a second transceiver configured to operate in a second RF band when the antenna structure is in a fully extended position (e.g., when the antenna is configured as a dual-band antenna). Alternatively, a single dual-band transceiver may receive signals from sensors 54 and/or circuitry 18 and be configured to operate in either a first radio-frequency band, a second RF band, or both RF bands depending on the position of the antenna structure (e.g., whether the antenna is partially or fully extended).

Figure 6:
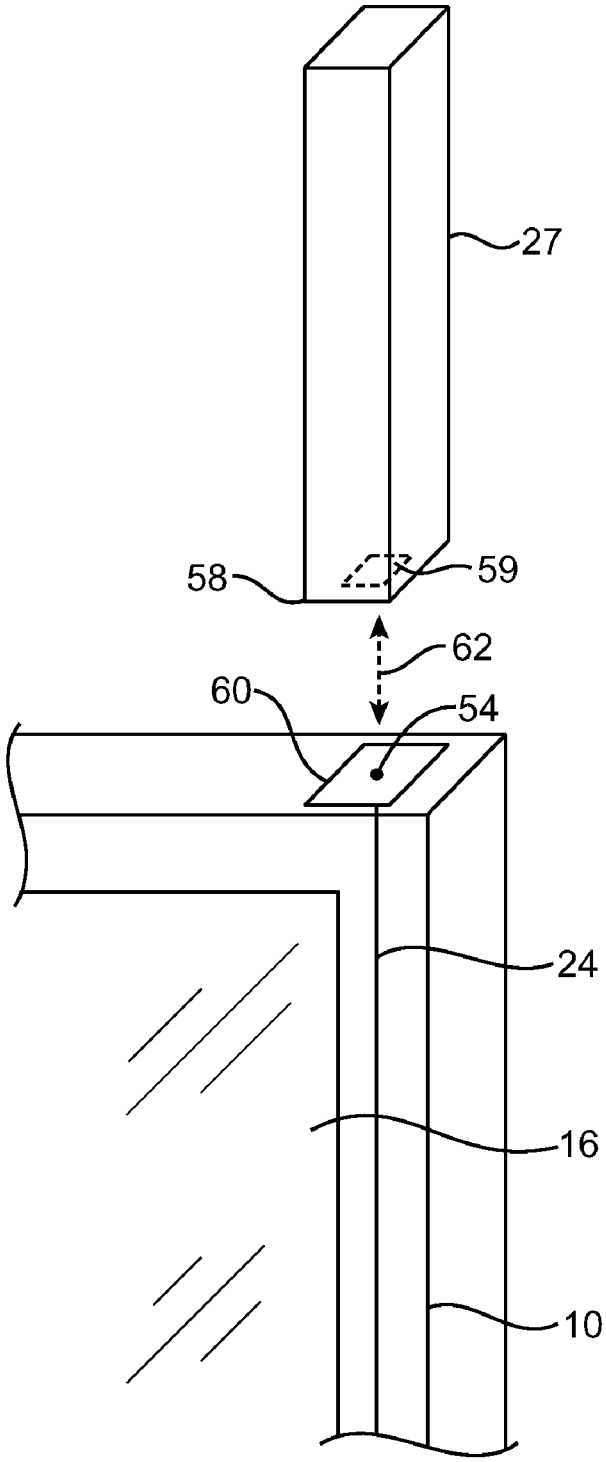
FIG. 6 is an exploded perspective view of a portion of an illustrative electronic device and an illustrative removable antenna in accordance with an embodiment of the present invention.

As shown in FIG. 6, a non-extendable, removable antenna such as antenna structure 27 may couple with device 10. Antenna structure 27 may have a coupling structure such as coupling structure 58 that is configured to couple with coupling structure 60 of device 10. The coupling structures may be configured to couple the antenna and the electronic device via a magnetic force. Alternatively, the coupling structures may utilize a physical coupling mechanism. Antenna structure 27 is shown just above its coupled position (e.g., as indicated by line 62).

Antenna structure 27 may have a magnetic portion such as magnet 59 (e.g., as part of coupling structure 58). In one suitable arrangement, sensor 54 in device 10 may be a Hall effect sensor that detects the presence of magnet 59. Sensor 54 may also be any other suitable sensor such as an optical sensor or a physical switch.

Signals from sensor 54 may be conveyed via communications path 24 to circuitry 18. Circuitry 18 may selectively power a radio-frequency transceiver when the signals from sensor 54 indicate that an antenna is coupled to device 10 (e.g., when structure 27 is coupled to device 10). For example, when sensor 54 fails to detect the presence of an antenna, circuitry 18 may conserve power by turning off radio-frequency transceiver circuitry in device 10.

An electronic device such as device 10 may present a user with alerts that indicate the status of a removable and/or extendable antenna. The alerts may be visual alerts displayed on a screen, audio alerts played over speakers, physical feedback such as vibrations generated by a motor connected to an offset weight, any other suitable alert, or a combination of such alerts. For example, when an antenna is extended, retracted, removed, or attached, device 10 may generate an alert for a user such as a visual alert message displayed on a screen and accompanied by an auditory beep. Visual alerts may be displayed on a screen such as display 16 or may be displayed using indicator lights that are separate from display 16. For example, device 10 may have indicator lights such as light-emitting diodes (LEDs) that are used to indicate the status of a removable and/or extendable antenna.

Figure 7A:
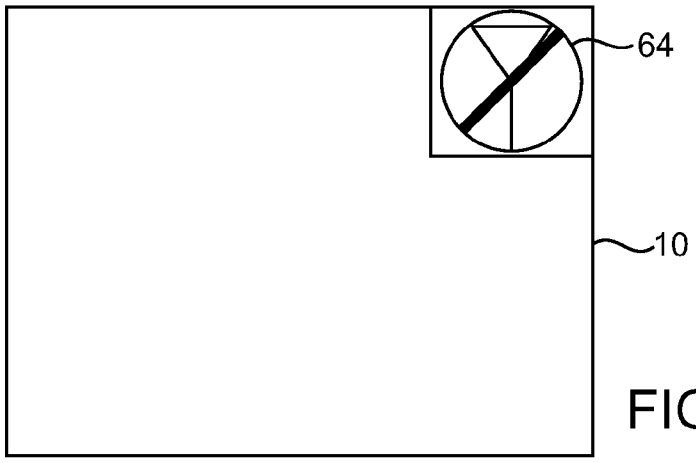
FIG. 7A is a front view of an illustrative status alert that may be displayed by an illustrative electronic device to indicate that an antenna and a transceiver are in an unpowered state in accordance with an embodiment of the present invention.

An illustrative visual alert that may be displayed by device 10 is shown in FIG. 7A. Alert 64 may include a symbol of an antenna with a line crossed through it that indicates that the antenna is not active, is not powered on, or is not in a state where the antenna could be utilized efficiently. For example, alert 64 may indicate that an extendable antenna is in a retracted position or a partially extended position and as such is not in a state to be efficiently utilized. Alert 64 may also indicate that an associated radio-frequency transceiver has been turned off. Alert 64 may be displayed when an extendable antenna is retracted such as when an extendable, removable antenna is attached and retracted. With one suitable arrangement, alert 64 may be displayed when a user or processing circuitry 32 has turned off or powered down an antenna and its associated radio-frequency transceiver (e.g., when wireless communications devices 40 are powered down).

Figure 7B:
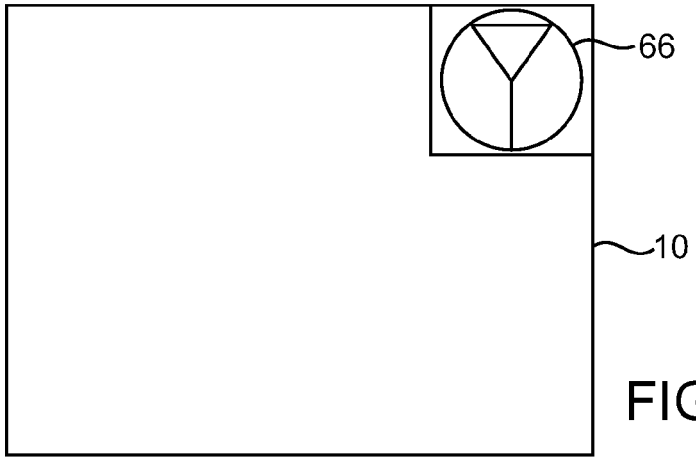
FIG. 7B is a front view of an illustrative status alert that may be displayed by an illustrative electronic device to indicate that an antenna and a transceiver are in a powered state in accordance with an embodiment of the present invention.

Alert 66 of FIG. 7B may be displayed by device 10 to indicate that an antenna is active and in position to transmit and receive radio-frequency signals efficiently. For example, alert 66 may be used by device 10 to indicate to a user that the antenna has been properly extended. Alert 66 may also indicate that an associated radio-frequency transceiver is active.

Figure 7C:
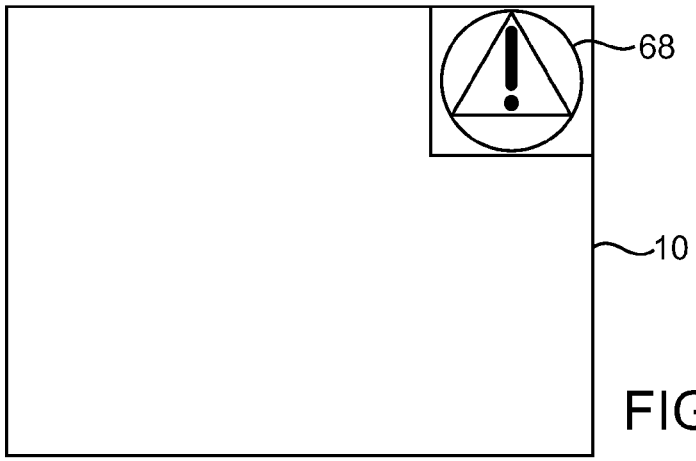
FIG. 7C is a front view of an illustrative status alert that may be displayed by an illustrative electronic device to indicate that an antenna is not coupled to the electronic device in accordance with an embodiment of the present invention.

FIG. 7C illustrates an alert that may be displayed by device 10 when a removable antenna is not attached to the device. Alert 68 may include a warning symbol displayed for the user to indicate that the removable antenna is not attached and that wireless communication activities are currently not possible. Alert 68 may also be used by device 10 to indicate the presence of an error in operating wireless communications devices 40. For example, alert 68 may be used to indicate when an attached antenna is incompatible with a radio-frequency transceiver in device 10 (e.g., when the antenna and the transceiver are not configured to operate in the same radio-frequency band). This may help remind a user to install an appropriate removable antenna.

Figure 7D:
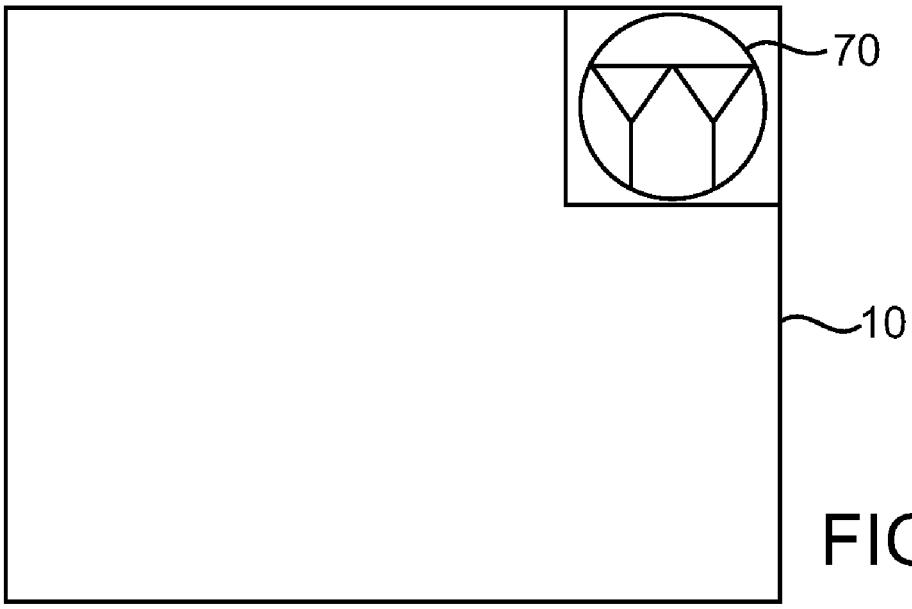
FIG. 7D is a front view of an illustrative status alert that may be displayed by an illustrative electronic device to indicate that a dual-band antenna and one or more associated transceivers are in a powered state in accordance with an embodiment of the present invention.

A dual-band antenna may be used to facilitate wireless communications in two separate radio-frequency bands. For example, a first band may be used for Wi-Fi communications and a second band may be used for cellular data communications. As illustrated by FIG. 7D, when a dual-band antenna is coupled to device 10 and is positioned to transmit and received radio-frequency signals (e.g., the antenna is extended), device 10 may display status information such as alert 70. Alert 70 may indicate that a dual-band antenna is properly configured for dual-band wireless communications (e.g., the antenna is coupled to device 10 and in an extended position).

Figure 7E:
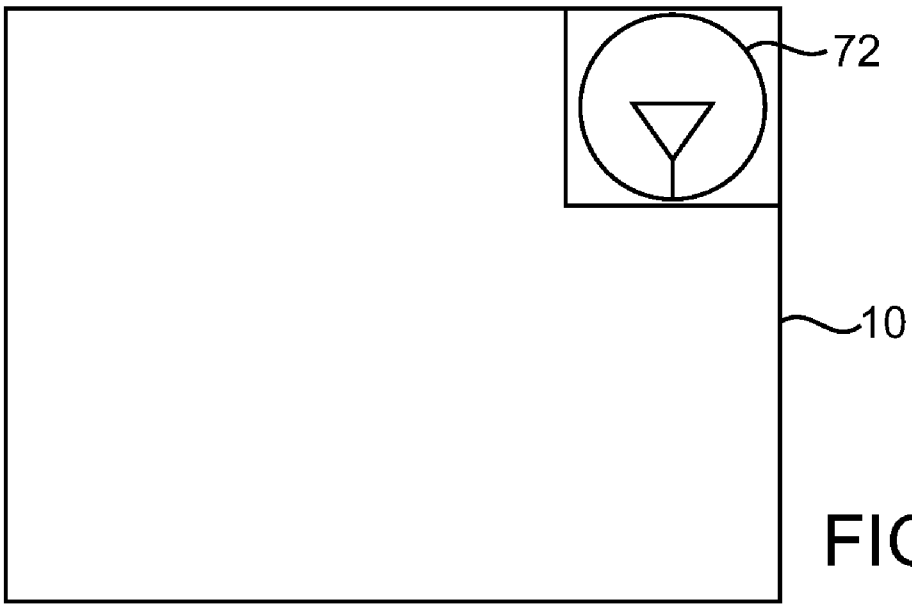
FIG. 7E is a front view of an illustrative status alert that may be displayed by an illustrative electronic device to indicate that an antenna and a transceiver are in a low-power state in accordance with an embodiment of the present invention.

An extendable and/or removable antenna may operate in more than one power consumption mode. For example, when a base station is nearby and radio-frequency signals are relatively strong, device 10 may conserve power by reducing the amount of power transmitted by a radio-frequency transceiver and associated antenna. Status information such as alert 72 of FIG. 7E may be displayed by device 10 to indicate when an antenna and associated transceiver are configured to operate with reduced power consumption. For example, the antenna may have more than one extended position. At least one of the extended positions may be used to control the power consumption of the antenna and its associated transceiver. For example, when the antenna is in a partially extended position, circuitry 18 may configure the transceiver and antenna to operate in a low-power mode.

Figure 8:
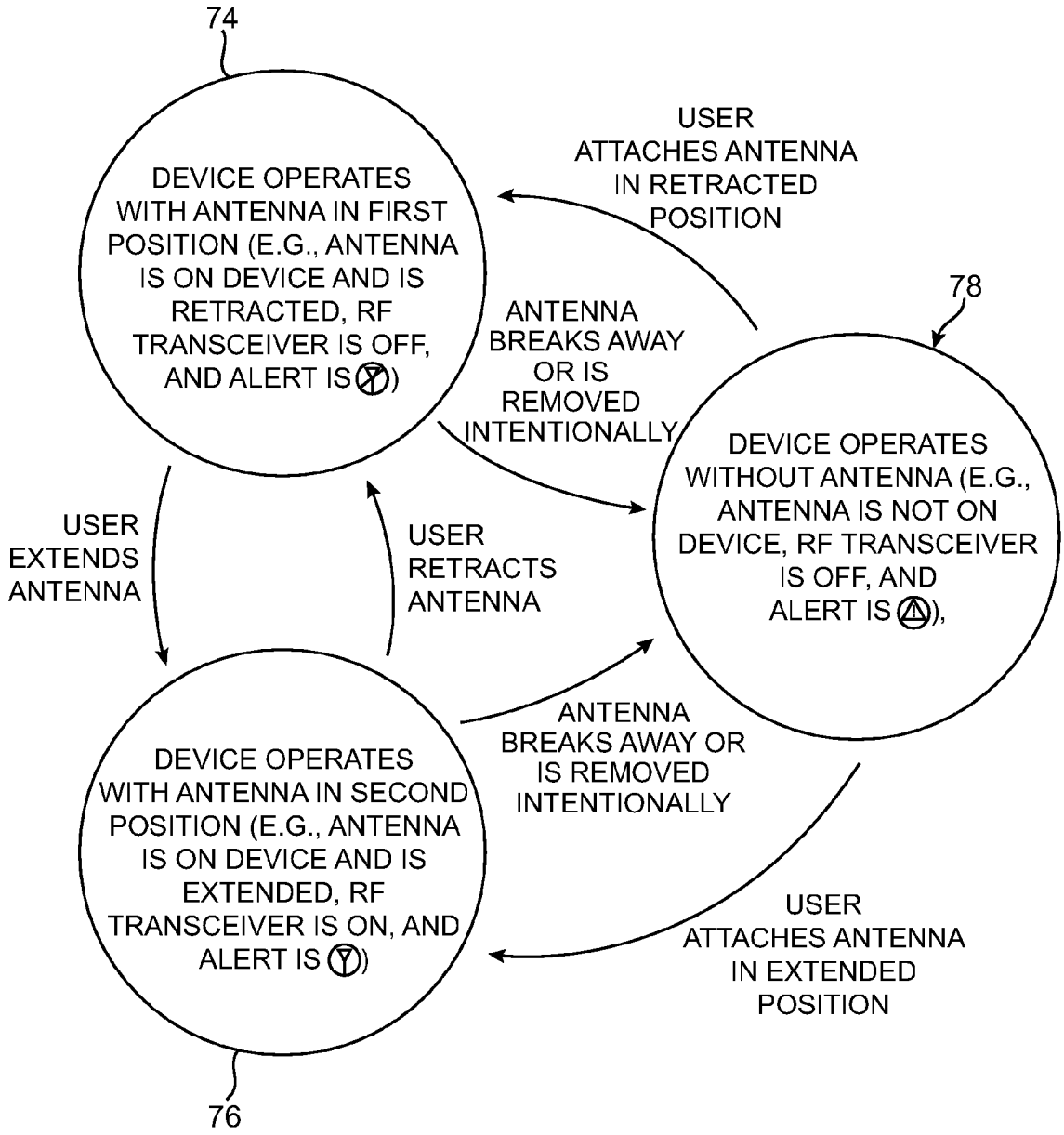
FIG. 8 is a state diagram of illustrative operational modes of an illustrative electronic device with an extendable and potentially removable antenna in accordance with an embodiment of the present invention.

As shown by FIG. 8, device 10 may have multiple operational modes (e.g., when device 10 has an extendable antenna). The extendable antenna may also be removable. For example, when the antenna is attached but retracted into its stowed position (e.g., the position of FIG. 1), device 10 may operate in mode 74. In mode 74, device 10 may not be able to perform wireless communications activities using the extendable antenna and an associated radio-frequency transceiver. Accordingly, device 10 may shut down the radio-frequency transceiver in order to reduce power consumption (e.g., to save battery life). Device 10 may also alert a user of the status of device 10. For example, when device 10 enters mode 74 from another mode, device 10 may alert the user with an auditory message such as a beep noise. With one suitable arrangement, device 10 may display alert 64 when the device is operating in mode 74. When a user attaches the antenna in a retracted position, device 10 may switch to mode 74 from the previous mode device 10 was operating in.

When device 10 is operating in mode 74 and a user extends the antenna into an extended position, device 10 may operate in mode 76. When device 10 is operating in mode 78 and a user attaches the antenna in an extended position, device 10 may operate in mode 76. In mode 76, device 10 may be able to perform wireless communications activities using the extended antenna and the radio-frequency transceiver of device 10. The transceiver of device 10 may be powered on (e.g., enabled) by device 10 when the device enters mode 76. Device 10 may also present an alert to a user of the device such as alert 66 or other suitable alert that indicates that the antenna is extended and/or active. A user may extend an extendable antenna to an extended position from either a fully retracted position or from a partially extended position. When a user retracts an extendable antenna to a retracted position from an extended position or partially extended position, device 10 may switch to an operational mode such as mode 74.

When device 10 is operating in mode 76 or in mode 74 and a removable antenna is removed from device 10 (e.g., the antenna is intentionally or unintentionally uncoupled), device 10 may begin to operate in mode 78. In mode 78, device 10 may not be able to perform wireless communications activities using the removable antenna its associated transceiver. When operating in mode 78, device 10 may turn off (e.g., disable) the transceiver in order to reduce power consumption. Device 10 may also present the user with an alert such as alert 68 indicating that the antenna is not attached or coupled to device 10. When a user removes or detaches a removable antenna, device 10 may enter mode 78.

Figure 9:
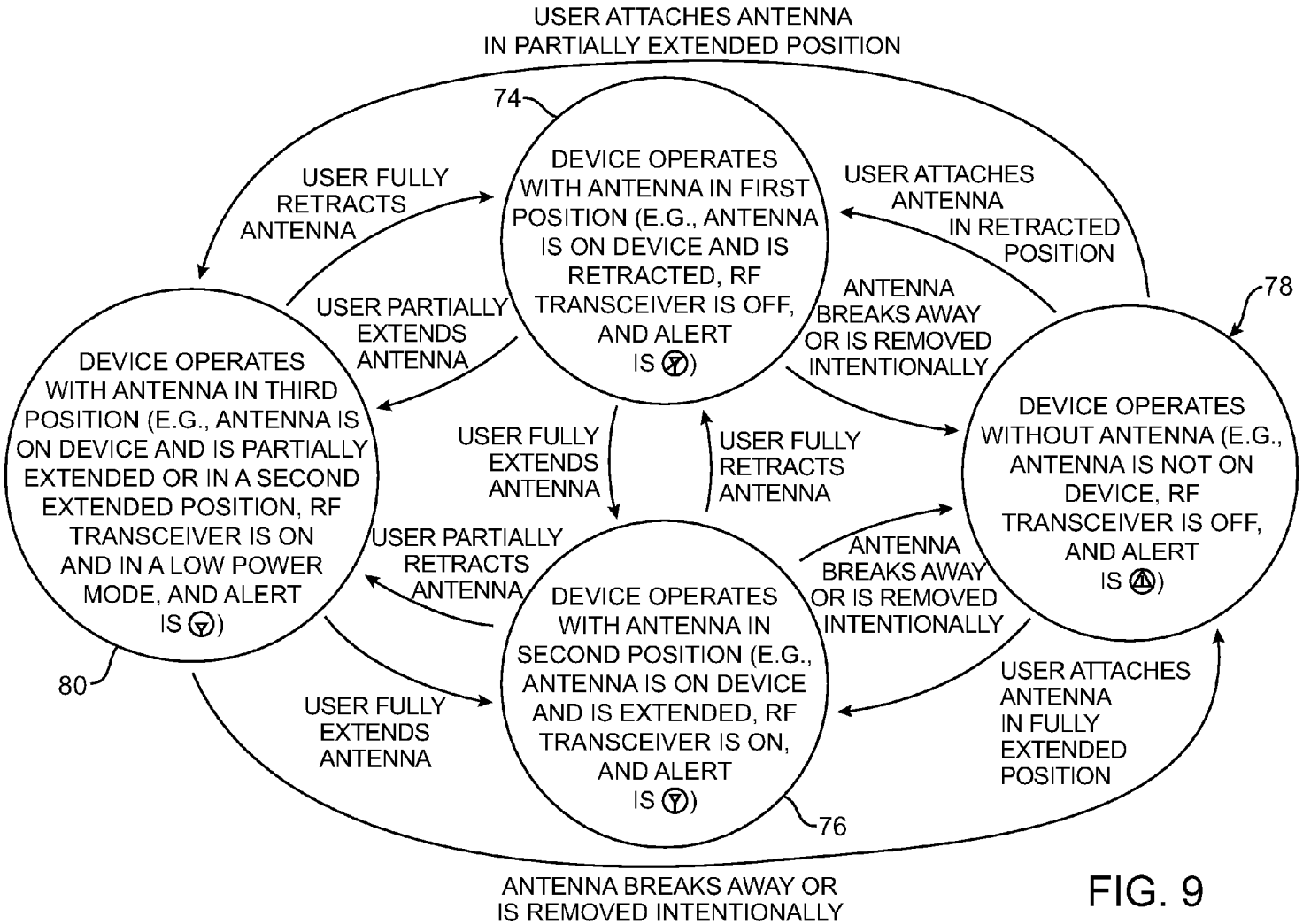
FIG. 9 is a state diagram of illustrative operational modes of an illustrative electronic device with an extendable antenna and potentially removable antenna that may operate in a high-power and a low-power mode in accordance with an embodiment of the present invention.

In embodiments in which wireless communications devices 40 (e.g., an antenna and transceiver) are configured to operate in either a full-power of low-power modes, device 10 may operate in operational mode 80 as shown in FIG. 9. With one suitable arrangement, the low-power mode is selected by a user by partially extending an extendable antenna and the full-power mode is selected by a user by fully extending the antenna. Mode 80 may correspond to a low-power configuration of an extendable antenna and its associated radio-frequency transceiver. Device 10 may also present a user with an alert such as alert 72 that indicates that the antenna and the transceiver are operating in a lower-power mode.

Figure 10:
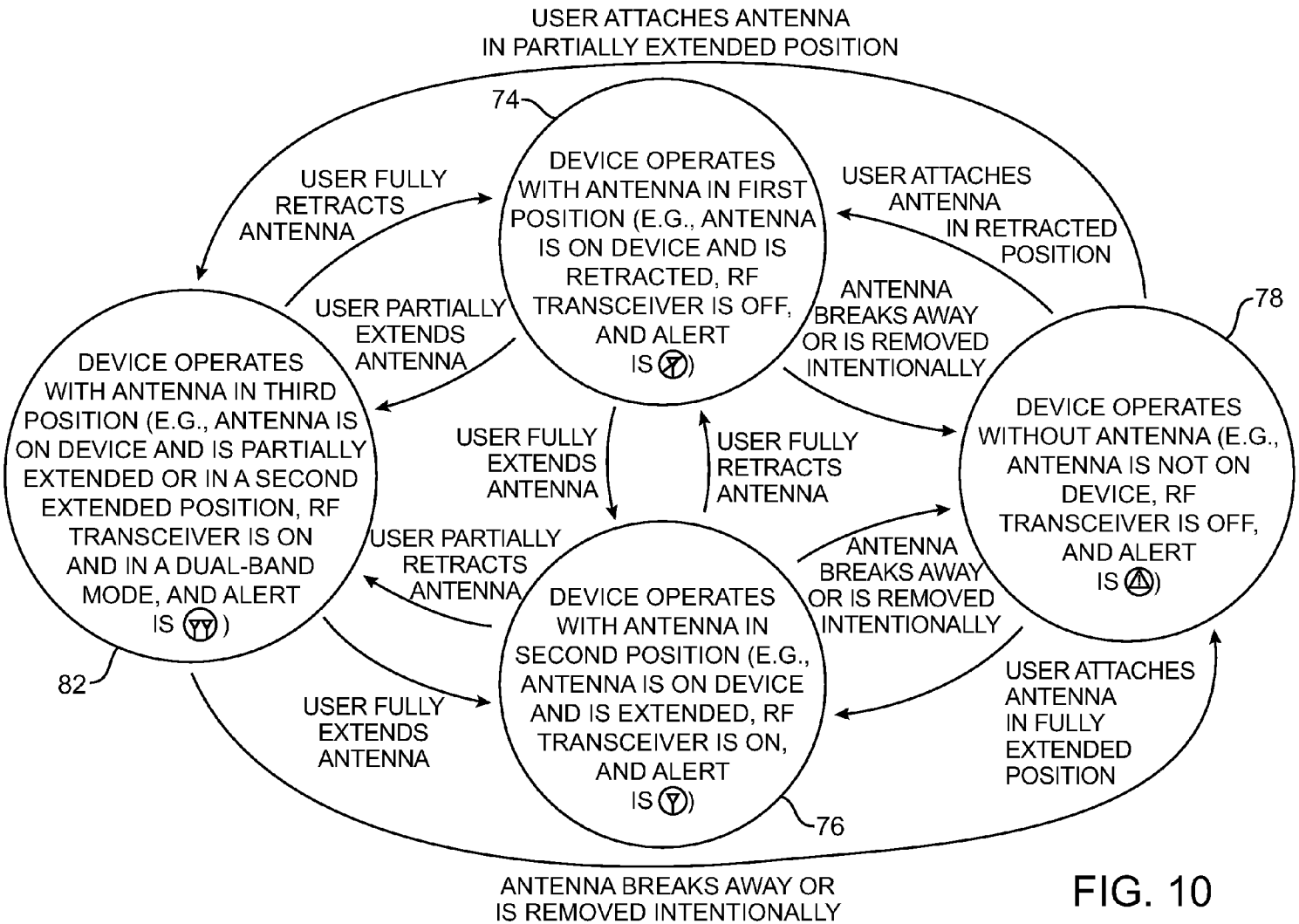
FIG. 10 is a state diagram of illustrative operational modes of an illustrative electronic device with a dual-band extendable and potentially removable antenna in accordance with an embodiment of the present invention.

Device 10 may also be configured with a dual-band radio-frequency transceiver and antenna structure 26, 26, or 29 may be configured as a dual-band antenna. In this type of scenario, device 10 may operate in mode 82 when the dual-band antenna is operated in a dual-band mode as shown in FIG. 10. For example, the antenna may operate in a single-band mode when the antenna is partially extended and may operate in the dual-band mode when the antenna is fully extended. Device 10 may activate dual-band functionality of a dual-band radio-frequency transceiver when the device is operating in mode 82. Device 10 may present a user with an alert such as alert 70 indicating that the antenna and transceiver are operating in a dual-band mode.

When a removable antenna in device 10 is removed from the device, device 10 may switch to operational mode 78. When a removable antenna is attached in a fully extended position or when the removable antenna is fully extended from a partially extended or retracted position, device 10 may switch to mode 76. After a removable antenna is attached in a partially extended position or after the removable antenna is moved from a fully extended position or a retracted position into a partially extended position, device 10 may operate in mode 80 or in mode 82. For example, when device 10 has an antenna that is in the partially extended position, device 10 may operate in mode 80 when the device has a transceiver with a low-power mode and device 10 may operate in mode 82 when the device has a transceiver with a dual-band mode. After a removable antenna is attached in a retracted position or after the antenna is retracted from an extended position, device 10 may operate in mode 74.

Figure 11:
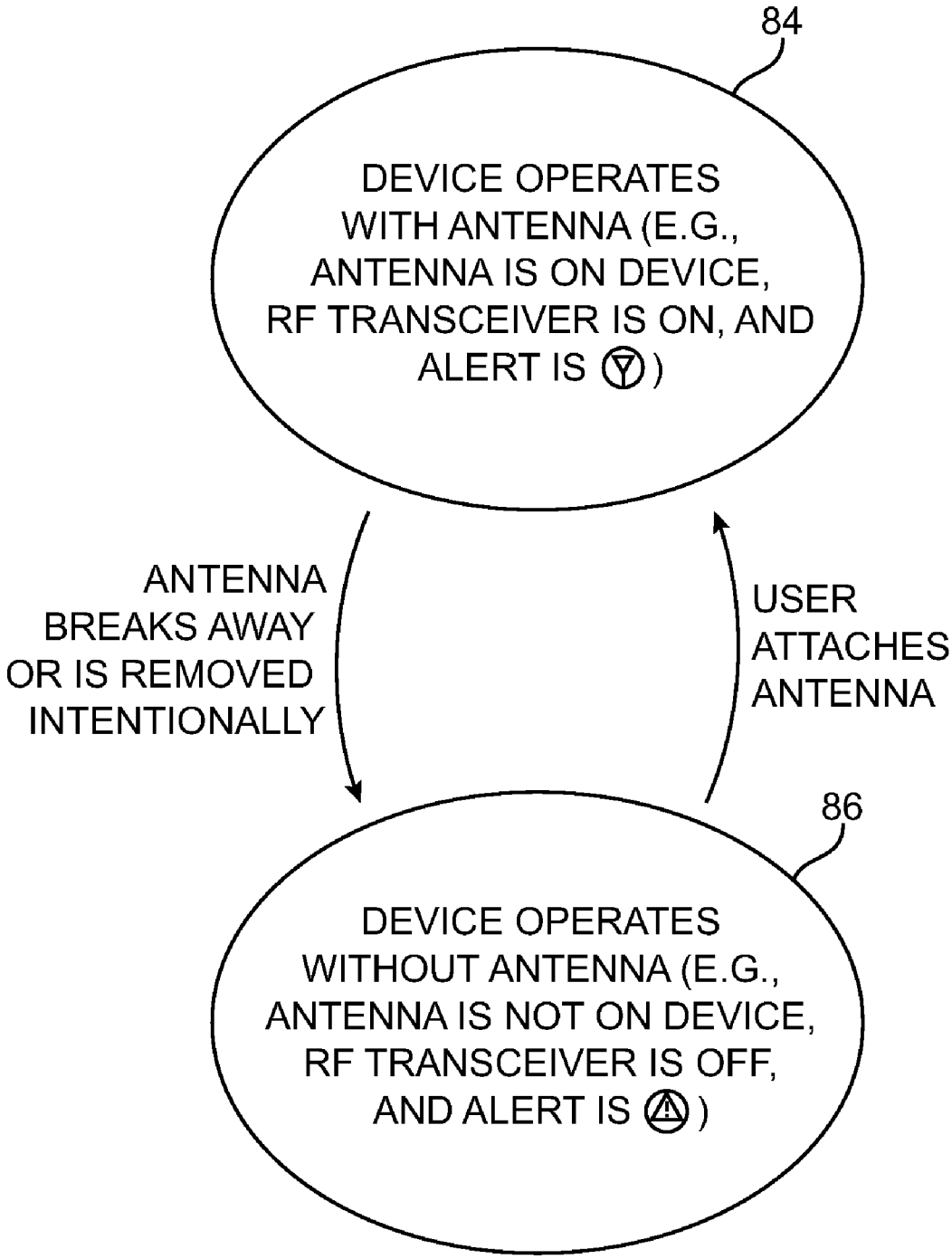
FIG. 11 is a state diagram of illustrative operational modes of an illustrative electronic device with a removable antenna in accordance with an embodiment of the present invention.

As illustrated by FIG. 11, when device 10 is configured with a removable non-extendable antenna such as antenna structure 27 of FIG. 2, device 10 may operate in one of two modes 84 and 86. Device 10 may operate in mode 84 when the antenna is attached or coupled to device 10. When in mode 84, device 10 may apply power to an associated radio-frequency transceiver and perform wireless communications functions. Device 10 may present a user with an alert such as alert 66 when operating in mode 84 that indicates that the antenna structure is attached.

When the antenna is not attached to device 10, device 10 may operate in mode 86 and may disable the radio-frequency transceiver associated with the detached antenna in order to reduce power consumption. Device 10 may present a user with an alert such as alert 68 that indicates that the antenna structure is not attached.

When a user attached a removable antenna to device 10, device 10 may switch to operating mode 84. After a user removes a removable antenna from device 10, device 10 may switch to operating mode 86.

Figure 12A:
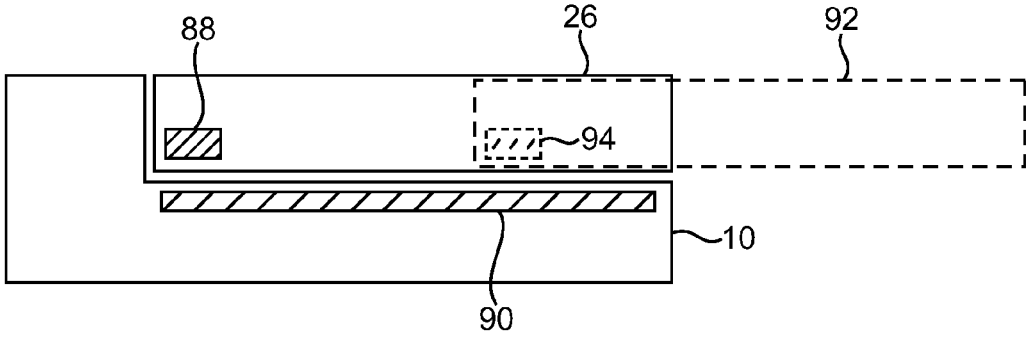
FIG. 12A is a cross-sectional view of a portion of an illustrative electronic device and an illustrative extendable and removable antenna in accordance with an embodiment of the present invention.

As shown in FIG. 12A, device 10 may have a sensor such as sensor 90 that may be used to determine the position of an extendable and removable antenna such as antenna structure 26. Sensor 90 may be a sensor based on the Hall effect (e.g., a magnetic field sensor). Sensor 90 may detect the proximity of a magnetic portion of antenna 26 such magnetic portion 88 (e.g., a magnet in the antenna). Sensor 90 may have an elongated shape in order to detect when the antenna is extended and when the antenna is retracted in addition to when the antenna is attached or detached. For example, in the antenna's retracted position, sensor 90 may be able to detect that magnetic portion 88 is at the position shown in FIG. 12A. When the antenna is in its extended position, the antenna may be in the position indicated by outline 92 and the magnetic portion may be at the position indicated by outline 94. In the extended position, sensor 90 may be able to detect that the magnetic portion of the antenna is at the position of outline 94.

Figure 12B:
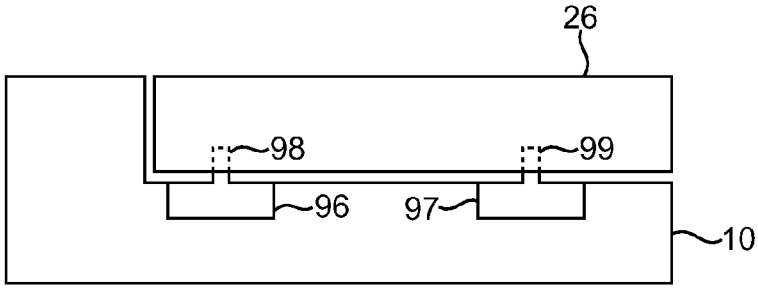
FIG. 12B is a cross-sectional view of a portion of an illustrative electronic device and an illustrative extendable and removable antenna in accordance with an embodiment of the present invention.

As shown in FIG. 12B, device 10 may have a one or more sensors such as sensor 96 and 97 that determine the position of an extendable and removable antenna (e.g., antenna structure 26). Sensors 96 and 97 may be mechanical switches that are depressed by the antenna structure. Outlines 98 and 99 may represent the position of the switch portion of sensors 96 and 97, respectively, when the antenna structure is not in contact with the respective sensor. For example, in embodiments in which the antenna extends by rotation, sensor 96 may be used to determine when the antenna is attached or detached. When the antenna is attached, sensor 97 may be used to determine when the antenna is extended or retracted. With another suitable arrangement, such as when device 10 has an antenna that extends by reciprocating along its length (e.g., line 28), sensor 97 may be used to determine when the antenna is attached or detached. In this example, sensor 96 is used to determine when the antenna is extended or retracted (e.g., while sensor 97 confirms the antenna is attached).

Figure 12C:
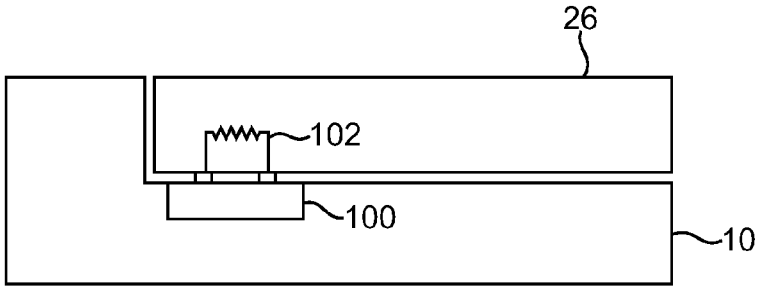
FIG. 12C is a cross-sectional view of a portion of an illustrative electronic device and an illustrative extendable and removable antenna in accordance with an embodiment of the present invention.

As shown in FIG. 12C, device 10 may have a sensor such as sensor 100 that senses the presence of a removable antenna. Circuit 100 may be formed from all of or a portion of an antenna resonating element. Sensor 100 may electrically couple with portions of antenna structure 26 such as circuit 102 (i.e., a resistor or other circuit in the antenna). Sensor 100 may determine when the antenna is attached by sensing the resistance between two terminals of sensor 100. For example, circuit 102 may complete a circuit between the two terminals of sensor 100 and provide that circuit with a known electrical resistivity.

With one suitable arrangement, circuit 102 may be formed from all of or a portion of an antenna resonating element in antenna 26 and circuitry 100 may be transceiver circuitry (e.g., circuitry 40) in device 10. In this situation, one of the two connections between circuit 102 and circuitry 100 (e.g., circuitry 40) may be coupled to communications path 22. The second connection between circuit 102 and circuitry 102 may be coupled to a return path to circuitry 40, as an example. When antenna structure 26 is in a position to transmit RF signals (e.g., attached and extended), the antenna structure may complete circuit 102 and circuitry 40 may be used to sense that circuit 102 has been completed. Circuit 102 may be configured to pass DC signals while blocking radio-frequency signals using an inductor, as an example, so that circuitry 40 can use DC signals to detect the status of antenna 26.

The foregoing is merely illustrative of the principles of this invention and various modifications can be made by those skilled in the art without departing from the scope and spirit of the invention.

What is claimed is:

1. An electronic device comprising:

an electronic device housing for the electronic device;

a break-away antenna that couples to the electronic device housing;

a radio-frequency transceiver in the electronic device housing;

a communications path;

at least one sensor that generates position signals on the communications path that indicate the position of the extendable break-away antenna relative to the electronic device housing; and control circuitry that receives the position signals over the communications path, wherein the control circuitry disables the radio-frequency transceiver when the position signals indicate that the break-away antenna is not coupled to the electronic device housing.

2. The electronic device defined in claim 1 wherein the break-away antenna comprises an extendable break-away antenna that retracts by rotating about an axis from an extended position away from the electronic device housing to a retracted position adjacent to the electronic device housing, wherein the at least one sensor comprises a sensor that determines when the extendable break-away antenna is coupled to the electronic device housing and that determines the position of the extendable break-away antenna relative to the electronic device housing, and wherein the control circuitry disables the radio-frequency transceiver when the position signals indicate that the extendable break-away antenna is in the retracted position.

3. The electronic device defined in claim 1 wherein the break-away antenna comprises an extendable break-away antenna that retracts by rotating about a rotational axis from an extended position to a retracted position, wherein the at least one sensor comprises a first sensor that determines when the extendable break-away antenna is coupled to the electronic device housing and a second sensor that determines the position of the extendable break-away antenna about the rotational axis, and wherein the control circuitry is configured to disable the radio-frequency transceiver when the position signals indicate that the extendable break-away antenna is in the retracted position.

4. The electronic device defined in claim 1, wherein the break-away antenna comprises an extendable break-away antenna that reciprocates along its length between an extended and a retracted position, wherein the at least one sensor comprises a first sensor that senses when the extendable break-away antenna is coupled to the electronic device housing and a second sensor that senses when the extendable break-away antenna is in the retracted position, and wherein the control circuitry is configured to disable the radio-frequency transceiver when the position signals indicate that the extendable break-away antenna is coupled to the electronic device housing and in the retracted position.

5. The electronic device defined in claim 1 wherein the break-away antenna comprises a magnet and wherein the at least one sensor comprises a Hall effect sensor that senses the magnet in the break-away antenna.

6. The electronic device defined in claim 1 wherein the at least one sensor comprises a mechanical switch and wherein the break-away antenna presses against the mechanical switch when the break-away antenna is coupled to the electronic device housing.

7. Apparatus comprising:

an electronic device having an antenna receptacle;

a resilient antenna that elastically flexes into a stowed position in the antenna receptacle, wherein:

the resilient antenna has a natural unbiased position;

when the resilient antenna is in the stowed position, the resilient antenna is elastically bent out of the natural unbiased position; and when the resilient antenna is in the stowed position, the antenna receptacle exerts a force on the resilient antenna that maintains the resilient antenna elastically flexed in the stowed position and that prevents the resilient antenna from elastically returning to the natural unbiased position;

a radio-frequency transceiver that transmits radio-frequency signals using the resilient antenna;

a sensor that determines the position of the resilient antenna, wherein the sensor generates position signals that indicate when the resilient antenna is in the stowed position;

a communications path; and control circuitry that receives the position signals over the communications path from the sensor, wherein the control circuitry disables the radio-frequency transceiver when the signals indicate that the resilient antenna is in the stowed position.

8. The apparatus defined in claim 7 wherein the resilient antenna comprises an elastically flexible wire.

9. The apparatus defined in claim 8 wherein the resilient antenna comprises a magnet and wherein the sensor comprises a Hall effect sensor that senses the presence of the magnet when the resilient antenna is in the stowed position.

10. A method of using an electronic device that has at least one antenna sensor, a break-away antenna that couples to the electronic device, and a radio-frequency transceiver that is electrically coupled to the break-away antenna, the method comprising:

determining whether the break-away antenna is coupled to the electronic device by generating position signals with the antenna sensor that indicate whether the break-away antenna is coupled to the electronic device; and in response to determining that the break-away antenna is not coupled to the electronic device, operating the electronic device with the radio-frequency transceiver disabled.

11. The method defined in claim 10 further comprising:

in response to determining that the break-away antenna is not coupled to the electronic device, displaying an alert for a user of the electronic device that indicates that the break-away antenna is not coupled to the electronic device.

12. The method defined in claim 10 further comprising:

in response to determining that the break-away antenna is coupled to the electronic device, operating the electronic device with the radio-frequency transceiver enabled.

13. The method defined in claim 10 further comprising:

extending and retracting the break-away antenna relative to the electronic device;

determining whether the extendable break-away antenna is in the extended or retracted position by generating position signals with the antenna sensor;

disabling the radio-frequency transceiver when it is determined that the extendable break-away antenna is in the retracted position.

14. The method defined in claim 13 further comprising:

when it is determined that the extendable break-away antenna is in the retracted position, displaying an alert for a user of the electronic device that indicates that the extendable break-away antenna is in the retracted position.

15. The method defined in claim 13 further comprising:

disabling the radio-frequency transceiver when the position signals indicate that the antenna is in a partially extended position between the extended position and the retracted position.

16. The method defined in claim 15 further comprising:

when it is determined that the extendable break-away antenna is in the extended position, displaying an alert for a user of the electronic device that indicates that the extendable break-away antenna is in a fully extended position.

17. The method defined in claim 13 further comprising:

determining from the position signals that the extendable break-away antenna is in a partially extended position between the extended position and the retracted position and disabling the radio-frequency transceiver in response.

18. The method defined in claim 13 further comprising:

determining from the position signals that the extendable break-away antenna is in a partially extended position between the extended position and the retracted position and placing the radio-frequency transceiver in a low-power mode in response; and when it is determined from the position signals that the extendable break-away antenna is in the extended position, operating the electronic device with the radio-frequency transceiver in a full-power mode.

19. The method defined in claim 18 further comprising:

when it is determined that the extendable break-away antenna is in the partially extended position, displaying an alert for a user of the electronic device that indicates that the electronic device is operating with the radio-frequency transceiver in the low-power mode.

20. The method defined in claim 13 further comprising:

determining from the position signals that the extendable break-away antenna is in a partially extended position between the extended position and the retracted position and placing the radio-frequency transceiver in a single-band mode in response; and when it is determined from the position signals that the extendable break-away antenna is in the extended position, operating the electronic device with the radio-frequency transceiver in a dual-band mode.

21. The method defined in claim 20 further comprising when it is determined that the extendable break-away antenna is in the extended position, displaying an alert for a user of the electronic device that indicates that the electronic device is operating with the radio-frequency transceiver in the dual-band mode.

* * * * *